US005718089A

United States Patent [19]

Dakin

[11] Patent Number: 5,718,089

[45] Date of Patent: Feb. 17, 1998

[54] ELONGATED DOWEL HINGE FOR DUTCH DOOR MINIATURE STABLE FACADE

[76] Inventor: Roy Clayton Dakin, 17 Prospect St., Searsport, Me. 04974

[21] Appl. No.: 593,066

[22] Filed: Jan. 29, 1996

[51] Int. Cl.[6] ..... E06B 1/04

[52] U.S. Cl. ..... 52/204.1; 52/204.7; 52/213; 49/142; 49/163; 49/168; 446/110; 446/479

[58] Field of Search ..... 52/204.7, 204.1, 52/213, 216, 476; 49/142, 163, 168, 501; 403/187, 231, 246; 446/110, 479

[56] References Cited

U.S. PATENT DOCUMENTS

| | | | |
|---|---|---|---|
| 445,614 | 2/1891 | Mehay | 49/168 |
| 1,195,203 | 8/1916 | Gillett | 49/142 |
| 1,573,194 | 2/1926 | Roe | 49/168 |
| 3,534,494 | 10/1970 | Majima | 446/110 X |
| 4,094,090 | 6/1978 | Wolmer | 446/110 |
| 4,216,608 | 8/1980 | Wolmer et al. | 446/110 |
| 4,400,906 | 8/1983 | Bové | 446/110 |
| 4,655,019 | 4/1987 | Rejc | 52/204.7 X |

*Primary Examiner*—Wynn E. Wood
*Assistant Examiner*—W. Glenn Edwards
*Attorney, Agent, or Firm*—Stan Jones, Patents

[57] ABSTRACT

A framed modular miniature front for a shelter, which front has a header, threshold and side rails together with an inner wall portion mounted on the surrounding frame. A full length door opening is formed in that wall adjacent a side rail of the modular frame. One or more dutch-type doors are swingably mounted in the opening by dowel hinges. This door opening is covered by a door pinned at the hinge side by a dowel pin that is seated in slightly oversized openings drilled lengthwise into the hinge side of the door. A swing space provides easy and full opening of the hinged door.

16 Claims, 6 Drawing Sheets

Figure 6A Section A - A'

Figure 6B Section A - A'

Figure 6C Section A - A'

ELONGATED DOWEL HINGE FOR DUTCH DOOR MINIATURE STABLE FACADE

FIELD OF THE INVENTION

The field of the invention relates to a new and improved module for a facade. More specifically, the field relates to miniature building facades, and more particularly to a dowelled hinge for dutch doors in facades of miniature stalls, stables, barns and the like.

DESCRIPTION OF PRIOR ART

In today's society few experiences match the joy of children playing with miniatures tools, barns, stalls, horses and farm animals. When such miniature devices are constructed of the real material, such as wooden barns, stalls, and lofts, an increased amount of realism is added and the child's joy is heightened. The assignee of this invention has provided such a full line of equestrian miniaturized toys that are presented in a catalog entitled Dakin's Quality Crafted Miniature.

That catalog presents a line of realistic horse and farm accessories. Included as prior art in the spring 1995 catalog, are show stalls, show lofts, stables, barns and combination tack room and show stalls. These miniature horse shelters include one or more sliding doors which are seated in longitudinal grooves located in upper and lower rails across the front of the shelter. In combination with the sliding doors are wall extensions that require their own stiles and supports.

Research and development for such miniature shelter construction led to a double dutch door approach wherein one or more upper and lower divided doors would replace the sliding doors of the prior art. Assembling such doors with an elongated dowel hinge in the hinge side of the doors construction itself led to improved assembly time and use of less material. Such construction also added a further touch of additional realism and thus increased the joy involved in playing with the improved miniature horse shelters.

A search was done and that search has disclosed a number of related references, most of marginal relevance, which references will now be discussed. Generally speaking, the references disclose a diverse number of method and apparatus for mounting single or divided doors. However, none of the search references demonstrate the integrated, novel features of this invention which provide an elongated dowel hinge pin that is seated in elongated openings drilled lengthwise through the hinge side of both door panels of a pair of divided dutch doors for fixed location in a modular front for a miniature horse shelter.

The prior art developed by the search included the following patents:

| | | |
|---|---|---|
| 5,231,809 | August 3, 1993 | Benjamino et al |
| 1,711,857 | May 7, 1929 | Ruttan |
| 1,284,349 | November 12, 1918 | Hull |
| 1,535,783 | April 28, 1924 | Klemm |
| 503,766 | August 22, 1893 | Mays |
| 2,568,130 | September 18, 1951 | Olson |

Taking the most pertinent patents of the search in the order listed above:

U.S. Pat. No. 5,231,809 Aug. 3, 1993 Benjamino et al

Benjamino discloses a dutch door that is also convertible into a single door type. The enlarged FIG. 2 view of Benjamino—discloses several readily apparent dissimilarities. The hinge is a separate element that is mounted on the hinge style of the structure and is separated into an upper and lower halves. The door halves, in turn, are also hinged together so that they may be folded and stored away during periods of non-use.

U.S. Pat. No. 1,711,857 May 7, 1929 Ruttan

Ruttan shows a half door for an automobile which was an early version of flush hinges. Clearly the structure is different than the present invention both as to location and purpose.

U.S. Pat. No. 1,284,349 Nov. 12, 1918 Hull

Hull discloses rather conventional type hinges 15 and 10 as shown in his FIGS. 1 and 2. Both the structure and method of the present invention is different than that disclosed by Hull.

U.S. Pat. No. 1,535,783 Apr. 28, 1924 Klemm

Klemm again discloses a common hinge construction.

U.S. Pat. No. 503,766 Aug. 22, 1893 Mays

Mays shows a window screen that includes a somewhat similar mounting principle for the upper and lower rails of each louvered screen panel. The dowel hinges however do not run the entire style length but instead only protrude slightly into the top and bottom of a screen frame. Moreover, Mays does not teach or suggest a dutch door assembly that provides a side rail having sufficient dimensions to receive an elongated hinge dowel through the vertical dimension of the door frame itself.

U.S. Pat. No. 2,568,130 Sep. 18, 1951 Olson

Olson again shows typical hinges 41, 12 and 13 in a combination storm, screen window sash configuration.

In summary, when one examines all of the prior art, one finds that they may attempt to solve one or two door hinge problems either separately or collectively. None, however suggest the multi-feature purposes of this invention of a modular front having a fixed dowel hinge pin running substantially full length and centered in a vertically-oriented door support style. This novel dowel pin feature includes a pin that is positioned at a location on the header and threshold so as to provide a swing space that allows the doors to open fully into a pocket storage space along the front. The novel hinge feature of this invention is available for single or divided dutch doors installed in a modular front for miniature shelters.

SUMMARY OF THE INVENTION

This invention provides a framed modular miniature front for a miniature shelter, which front has an inner wall portion mounted on a substantially rectangular surrounding frame with a full length door opening in that wall, which opening is covered by a door pinned at the hinge side by a dowel pin that is seated in slightly oversized openings drilled lengthwise, or substantially so, into the hinge side of the door. This hinge pin is set in the upper header and lower threshold beams of the front at an offset location that provides a swing space allowing the hung door to fully open back for storage against the front wall of the modular front.

Each dutch door of a divided door installation is framed with a hinge-side style that is about three or more times the width of the diameter of the dowel hinge in order to accommodate the dowel hinge and yet provide enough structure support for the hinge and the door. Each such door is covered by exterior planking that is secured to the door frame with a slight overlap on the modular front frame at the handle side. The doors in place are mounted vertically one above the other and the dowel pin seats in the mounting side of the doors and is also fixably seated with the swing space in openings placed in the upper header and foot frame portions of the shelter's modular front.

The dutch doors, with the dowel pin in place, have a swing space between the inner side of the door frame's vertical style and the modular wall. Door mounting with this swing space allows the doors to open wide and swing back for storage in pockets along the modular wall.

OBJECTS OF THE INVENTION

It is an object of the present invention to provide a modular miniature shelter front having a door with a style that is hinge pin mounted in the modular front.

It is yet another object of this invention to provide a modular facade for a miniature shelter having upper and lower dutch doors swingably mounted on the hinge side by a full length dowel pin seated in slightly oversized openings through door frames.

It is still another object of this invention to provide a pair of divided doors each having a surrounding frame and planking on the frame with the doors swingably seated on a dowel hinge pin that is seated at its upper and lower exposed ends in a header and a foot rail of a modular front for a miniature shelter.

It is a further object of this invention to provide upper and lower swinging dutch doors mounted on a fixed hinge pin, with the doors having oversized vertical openings in the door frames such that the doors are free to swing about the vertically mounted hinge pin.

It is yet one further object of this invention to provide mounted dutch doors with a longitudinal swing space between the inner side of the door frame's vertical style and the exterior of the modular wall in order to allow the doors to open wide and be stored, when the doors are swung wide open, in pockets along the modular wall.

DESCRIPTION OF THE PREFERRED EMBODIMENT(S)

Figure 1:
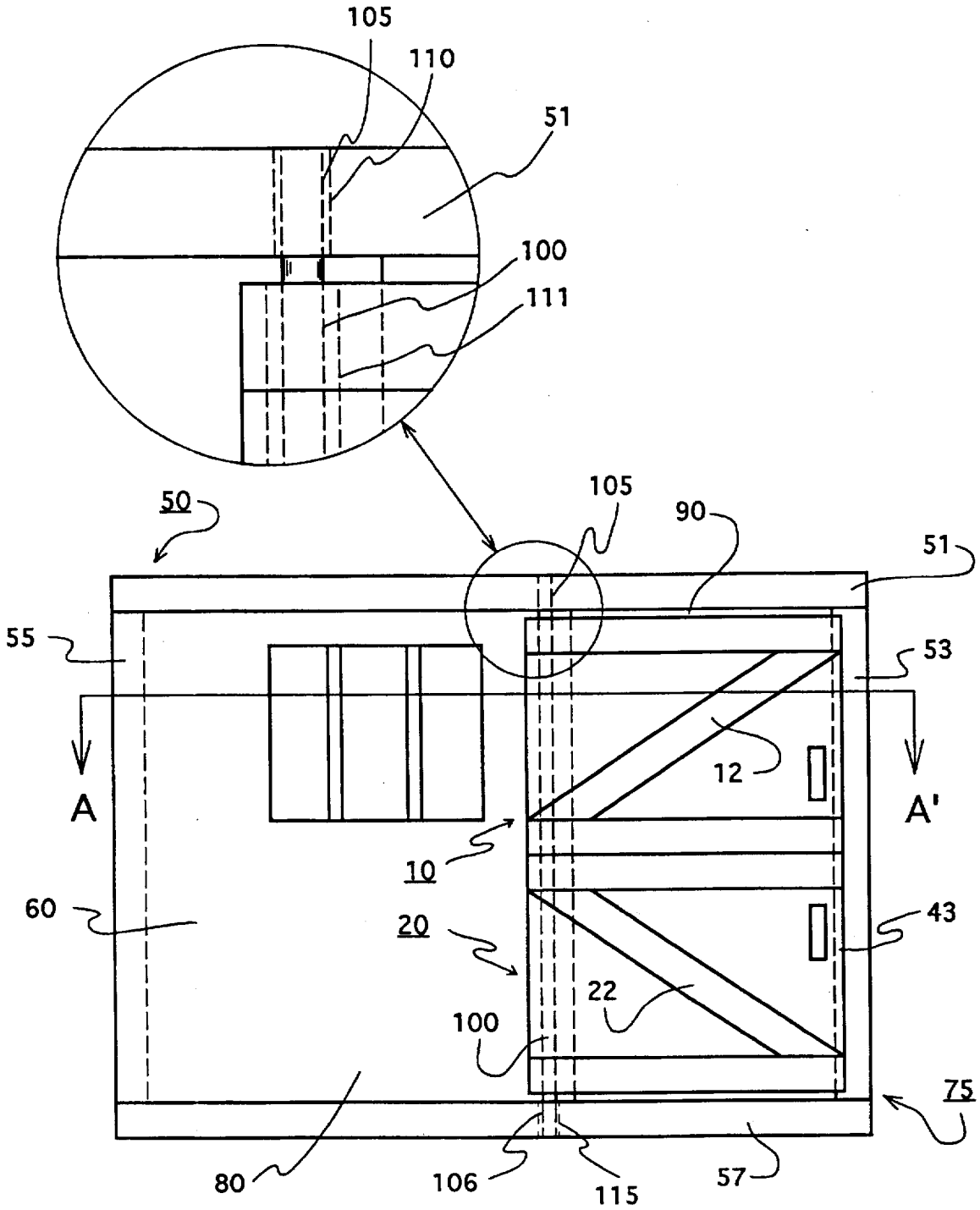
FIG. 1 shows a front plan view of a pair of upper and lower dutch doors swingably mounted in a modular front in accordance with this invention.

Turning now to FIG. 1, a front plan view of a modular front 50 for a stall, barn, stable or the like is shown. Modular facade 50 includes a pair of upper and lower dutch doors 10 and 20 which are swingably mounted in modular front 50 on a full length hinge pin 100 in accordance with this invention. The exterior of door 10 has a "Z" shaped exterior railing 12 and door 20 has a reverse "Z" shape support railing 22 for a pleasing exterior door and front design.

Modular front 50 has a surrounding frame 75 which includes an upper header beam or rail 51, two side rails 53 and 55 and a foot, or threshold beam 57. Pin 100 runs the full length of the door opening 90. Pin 100 is securely fixed at the upper and lower locations by cement, dowels or nails as need to secure the pin 100 to the upper and lower rails 51 and 57.

FIG. 1 also depicts one pair only of upper and lower dutch doors 10 and 20 on a modular front as sized for a small shelter such as a single stall or a small tack room. It should be understood, however, that the principles of this invention are equally applicable to a larger front facade such as that provided on multiple stalled barns with single one piece and/or divided doors as needed on the right, left and/or center sections of wall 60.

As shown in FIG. 1, the front wall 60 includes a door opening 90. Two dutch doors halves 10 and 20 are horizontally divided at about the vertical midpoint and are selected with dimensions to fully cover that door opening 90. FIG. 1 includes a sectional line designated as 6A-6A'. It is important to note that as the doors swing open, the dutch doors 10 and 20 swing fully into a pocket space 80 arranged for receiving a fully open door panel against the front wall 60.

Figure 2:
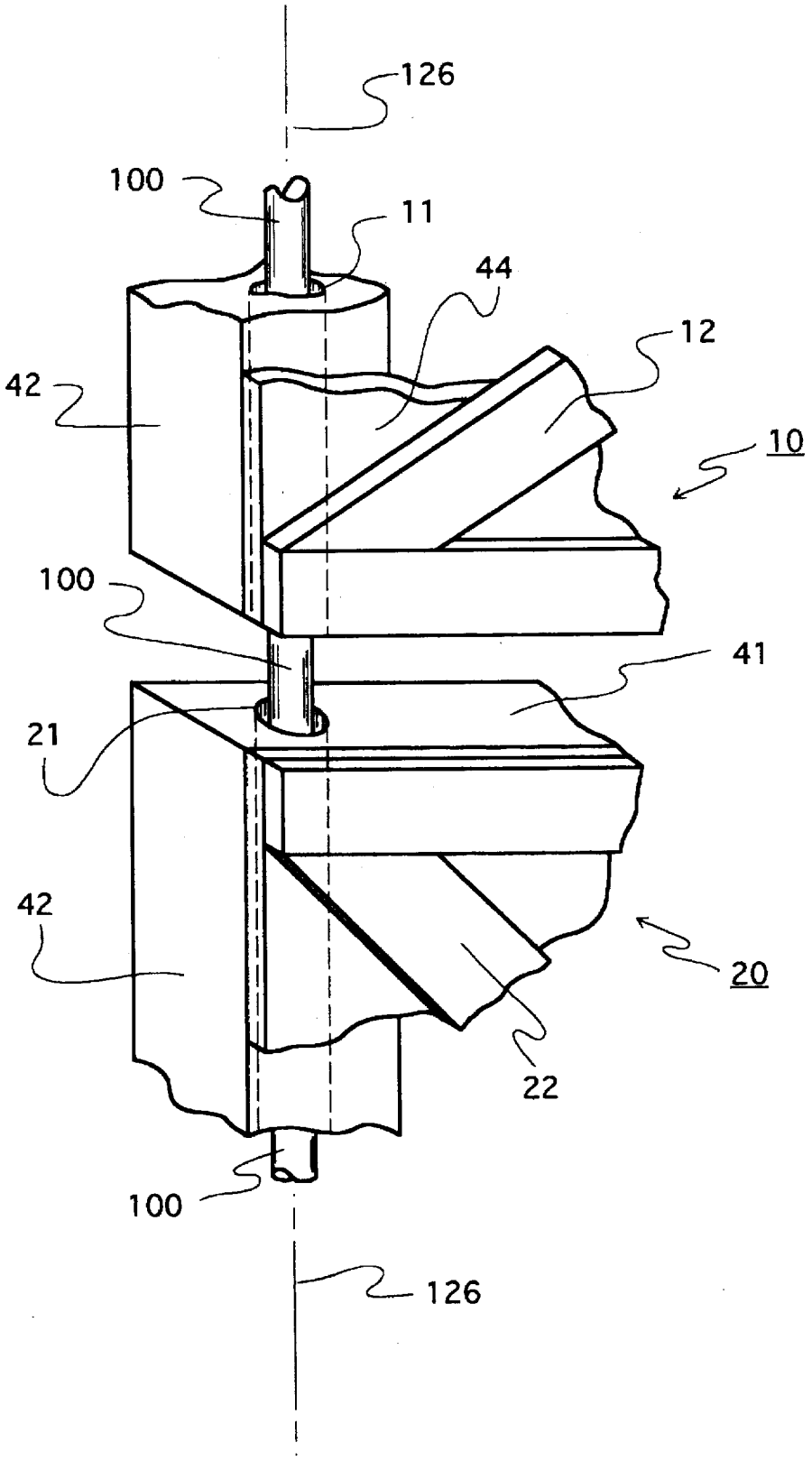
FIG. 2 shows a cutaway with a partial cross-section view of a full length dowel pin mounting for the dutch doors of FIG. 1.
Figure 6:
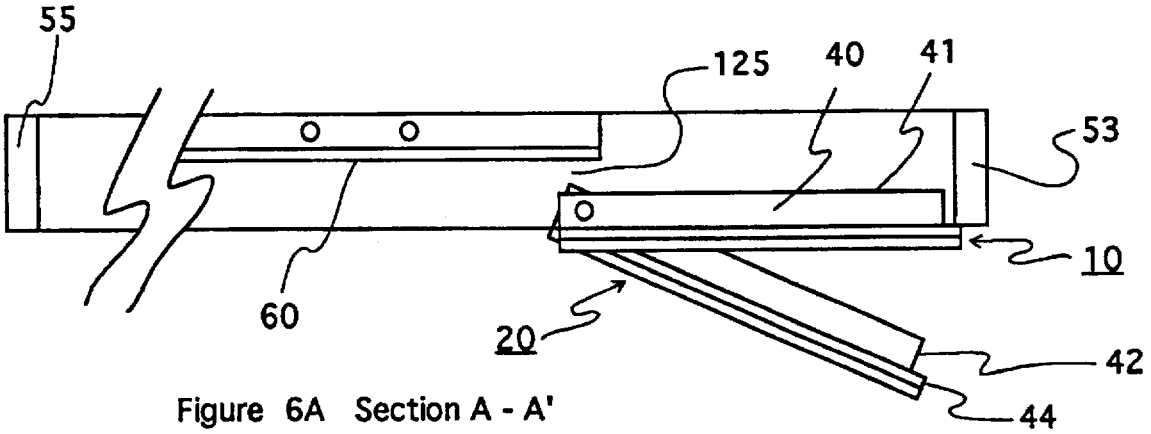
FIG. 6 includes FIGS. 6A, 6B and 6C which show a sectional view of the modular front taken along the section lines 6A-6A' in FIG. 1 with the dutch doors swung open in varying amounts.
Figure 6:
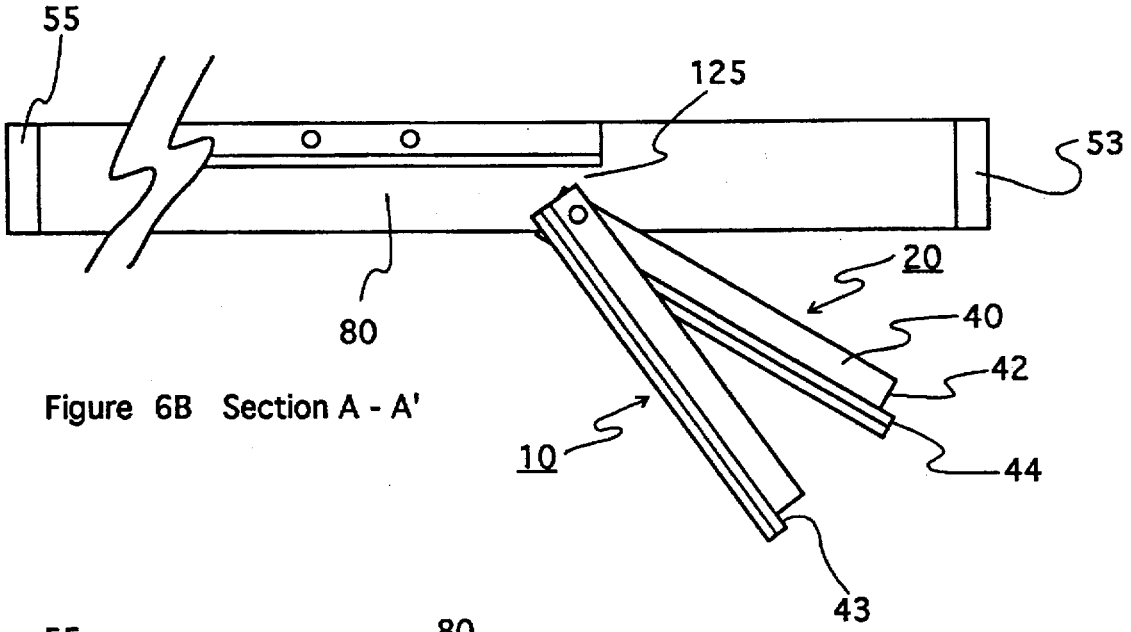
Figure 6:
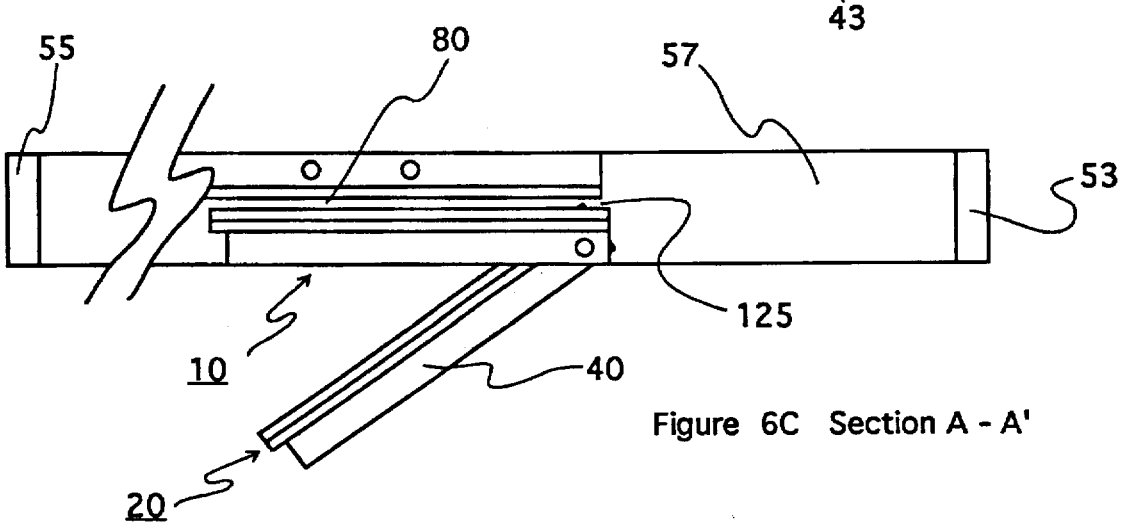

In FIG. 6, these door halves 10 and 20 are shown at FIGS. 6A, 6B and 6C with different degrees of partially open positions. Both of the inner planes of such doors are provided with a surrounding rectangular frame 40, which frame includes a pair of equal length upper and lower rails 41 and side styles 42. FIG. 2 is a partial cross sectional view depicting portions of these door frames. FIG. 6, also in a symbolic way, depicts the swing space 125.

Each dutch door halve also includes some form of facing, siding or planking 44, FIG. 2. Such planking, at the hinge location, is essentially flush with the door frame side 42; but, this planking 44 overlaps the other side rail 42 by a small amount 43 as best shown in FIG. 1 and FIG. 6A. The door frame dimensions plus the overlap 43 is selected such that the door frames, when hinged for use, seat within the door opening 90 and the planking overlap 43 butts against the side rail 53 of modular frame 50 when the door is in a closed position.

FIG. 1, reveals that the hinge dowel 100 is a full length dowel that is selected to be longer than the vertical dimensions of both dutch door halves 10 and 20. An upper exposed end 105 of dowel hinge 100 is seated in a bore 110 that has been pre-drilled through the upper or header beam 51 of modular front 50. Likewise an exposed lower end 106 of dowel pin 100 is seated in a pre-drilled receiving bore 115 in the threshold beam 57 of modular front 50.

Both of the doors 10 and 20 have lengthwise openings 11 and 21, FIG. 2, drilled along a hinge axis 126 running lengthwise of both vertical side rails 42. The diameter of such bores 11 and 21 is selected to be slightly larger relative to the diameter of dowel pin 100. These oversized bores 11 and 21, running the full length of side rails 42, allows each door 10 and 20 to be swingably mounted on hinge pin 100.

After hinge dowel 100 has been inserted in the openings 11 and 21, the exposed upper and lower ends 105 and 106, FIG. 1, are fixably seated in the receiving bore openings 110 and 115 located respectively in the header and threshold rails 51 and 57. Those exposed ends 105 and 106 are anchored or fixed in place by any suitable means such as by small brads 120, glue or the like. Please see FIG. 5.

Since the dowel pin 100 is slightly undersized relative to bores 11 and 21 through the door frame side hinge rails 42, the doors are readily mounted for ease of swinging on the dowel pin 100. In use these dutch doors 10 and 20 bind slightly against one another at the midpoint sections and that binding action is used to advantage since the doors will stay open at any given placed location.

Figure 5:
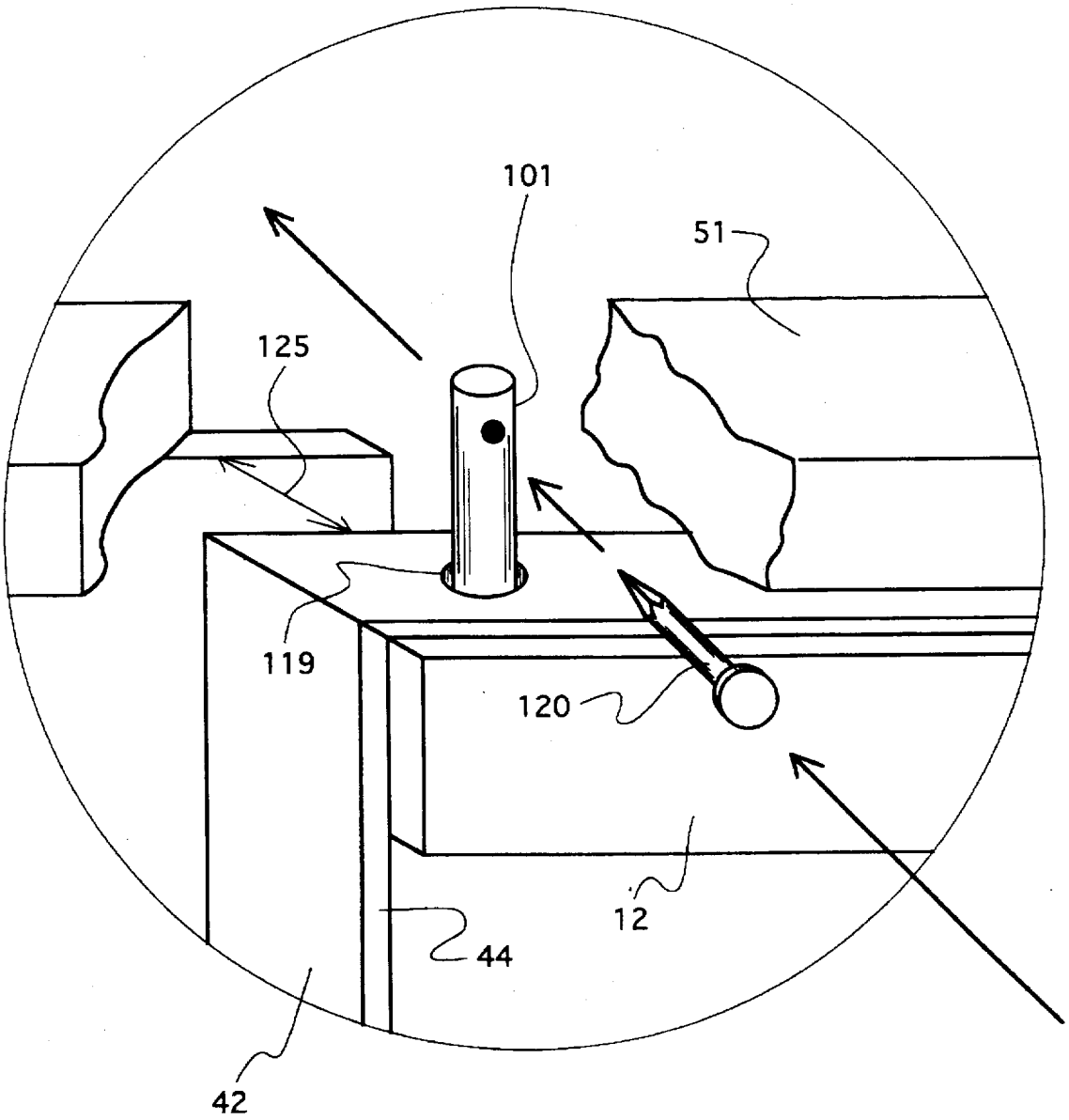
FIG. 5 shows a top view of the modular front having the hinge pin secured at its upper end in the upper beam of the modular front.

As shown in FIG. 5, a swing space 125 is left between the hinged side of the doors 10 and 20 and the wall 60. That space 125, of course would not be tolerated in a habitable structure. Quite unlike a habitable structure, that swing space 125 is of no concern in miniature shelter devices as herein contemplated for this invention. Indeed, as shown in FIG. 6, the swing space 125 allows the doors to open fully without contacting wall 60 during the hinging action. When fully open as depicted in FIG. 6C for door 10, either or both doors swing back into storage pocket 80. That open and stored position is best illustrated by door 10 in FIG. 6C.

Figure 3:
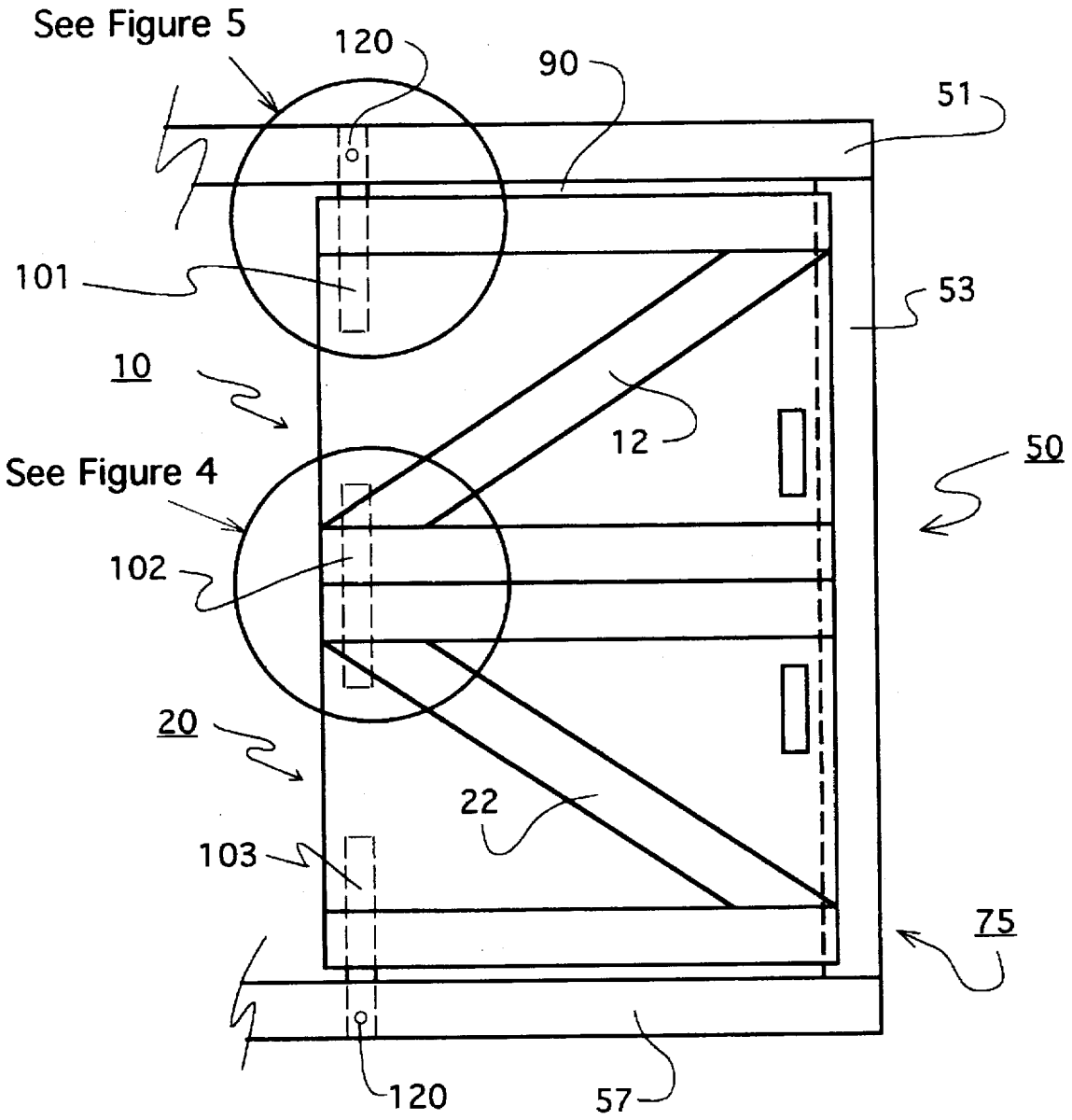
FIG. 3 shows a view similar to FIG. 1 with a mid-piece dowel pin mounting for a pair of dutch doors in a modular front for a miniature shelter.

FIG. 3 shows a view similar to FIG. 1 with a mid-piece dowel pin mounting for a pair of dutch doors 10 and 20 located at the left hand vertical style of a modular front 50 for a miniature shelter. That mid-piece dowel is shown in an enlarged partial cross-section view in FIG. 4.

The three piece dowel mounting of FIG. 3 is similar to that described for FIG. 1, except that the boring procedure for the doors 10 and 20 is simplified in some aspects from that for the door(s) of FIG. 1. In this alternative embodiment, the single full length dowel pin 100, is replaced by three separate dowel pin sections 101, 102 and 103 which respectively form an upper, middle, and lower dowel pin hinge.

Figure 4:
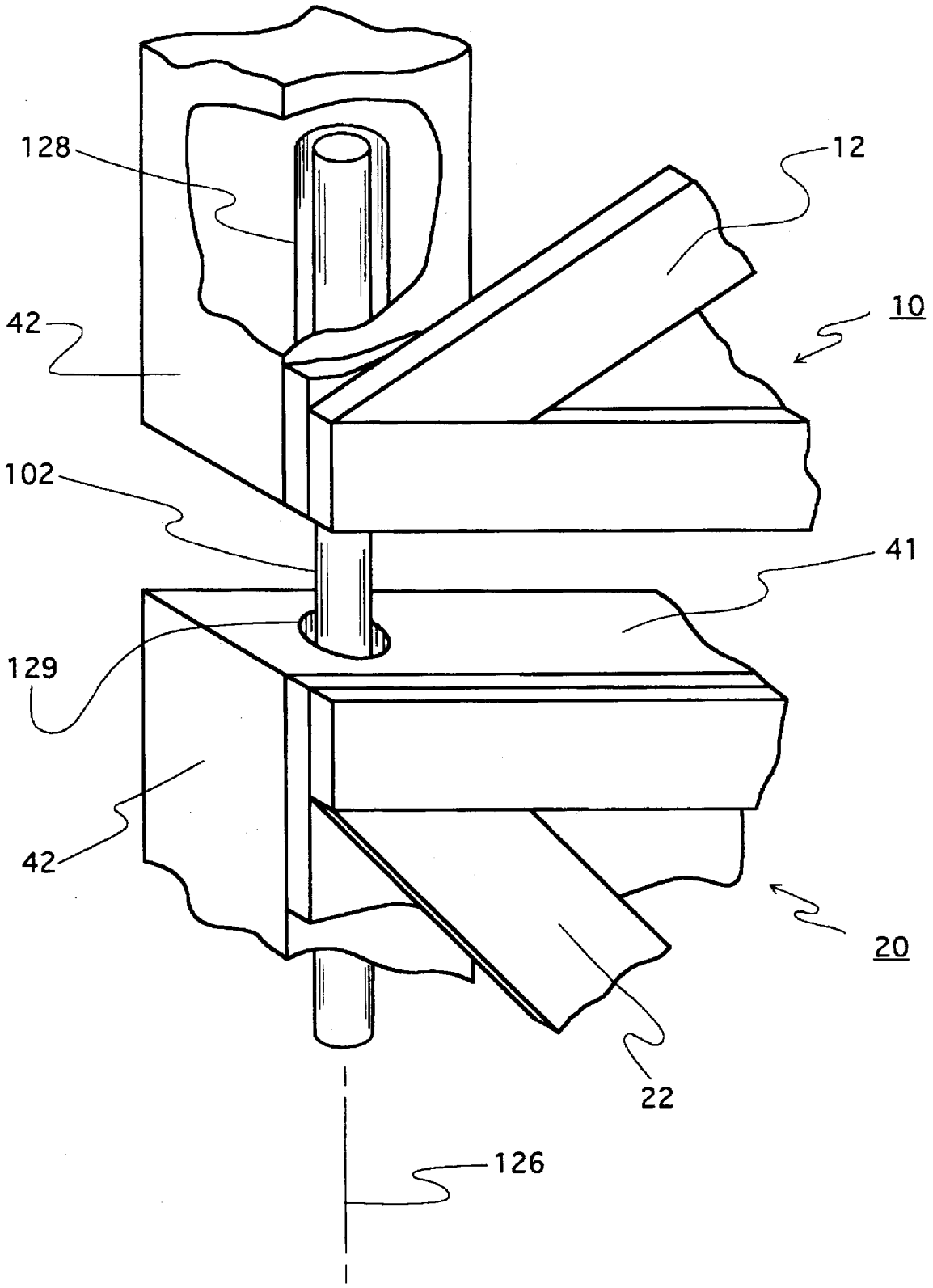
FIG. 4 shows a view similar to FIG. 2 with an enlarged partial cross-section view of a mid-piece dowel in accordance with FIG. 3.

In the embodiment of FIGS. 3 and 4, the upper and lower receiving bores 128 and 129, FIG. 4, while still lying along the vertical hinge axis 126, only enter at a partial depth in each of the hinge styles 42 on right-handed doors 10 and 20. As discussed earlier for FIG. 1, the upper and lower hinge sections 101 and 103 are again fixed at the header and threshold rails 51, 57 by any suitable means such as brads 120, FIG. 5.

The center hinge section 102 is seated in slightly oversized receiving bores 128, 129 and serves a dual purpose of providing swingability and lockability for holding doors 10 and 20. Middle hinge pin section 102 is seated in bore 128 and 129 respectively located as shown in doors 10 and 20, FIG. 4.

The length of dowel section 102 is chosen to provide sufficient support for the assembled doors. Thus middle dowel pin section 102, FIG. 4, is chosen to extend well into the bottom and top respectively of doors 10 and 20 so that the doors 10, 20 will keep their mounted position and yet will allow the user to swing such doors fully open for storage in pocket 80, FIG 6.

Among the advantages of the embodiment of FIGS. 3 and 4 is that the styles 42 need not be drilled full length. Partial depth for the receiving bores 128 and 129 make the modular assembly quicker to complete, less precise in boring specifications, involves less material and yet is fully serviceable for the intended function of a dutch door hinge structure. As discussed earlier a swing space 125 is necessary for fully opening doors 10 and 20 of FIGS. 3 and 4.

Clearly the lengths for dowels 101, 102 and 103, FIGS. 3 and 4 are only approximate. If the door opening 90 is a total of about 9 to 10 inches, with each door panel being about 5 inches long, the upper and lower dowel pin sections need be only about and inch or so in length, while the middle section should perhaps be about three inches in length for sufficient support.

Jig and fixture assemblies for my modular facades invention are simplified by this novel structure. My dutch door design allows a child to open only the upper section while the miniature horse or farm animal puts its head out of the open section for realism while the stall remains closed at the bottom door panel 20. The entire barn structure being easily fabricated from wooden including dowel pin 100 provides enhanced realism for the user.

While my invention has been described with reference to a particular example of preferred embodiments, it is my intention to cover all modifications and equivalents within the scope of the following claims. It is therefore requested that the following claims, which define my invention, be given a liberal interpretation which is within the spirit and scope of my contribution to this art.

What is claimed is:

1. A modular wall front for a miniature non-habitation shelter such as doll houses, miniature stalls and similar sized shelters useful for child's play, which front comprises:

a miniature header beam, a miniature threshold beam, and miniature side rails affixed thereto for forming an essentially miniature rectangular modular frame adaptable as a vertically oriented closure for an opening in said miniature shelter;

a wall portion mounted on said modular frame;

a full length door opening formed in said wall portion, with said door opening located adjacent a side rail of the modular frame;

a miniature door having a vertical hinge style in a door frame;

a miniature dowel pin hinge slightly longer than the length of said door frame's vertical hinge style;

fitted bores relative to the size of said dowel pin drilled lengthwise into said vertical style of said door frame on the hinge side of said door in order to form a binding hinge axis for said door, exposed upper and lower stub sections of said dowel hinge extending beyond an upper and lower end of said door frame's vertical style; and means fixably mounting said upper exposed stub section of said dowel pin hinge in said miniature header and said lower exposed section of said dowel pin hinge in said miniature threshold beam such that said door is swingably mounted to open and close said door opening in said wall portion of said modular wall front.

2. A modular wall front for a miniature shelter in accordance with claim 1, wherein said miniature door is a divided dutch door with an upper and a lower door section hinged along a vertical hinge axis centered in said binding hinge pin, and wherein said modular wall front further comprises:

said dowel pin mounts said miniature door halves in a vertical plane with one door section located above the other dutch door section; and said exposed dowel pin sections are fixably seated in tight fitting openings placed along the hinge axis in the header and threshold beams of said modular frame.

3. A modular wall front for a miniature shelter in accordance with claim 2, which front further comprises:

siding covering each of the divided door sections;

said siding extending slightly beyond and overlapping the door frame and abutting against the side rail of said modular frame when said door is in a closed condition.

4. A modular wall front for a miniature shelter in accordance with claim 3, which front further comprises:

said siding overlap on the handle side of said miniature door sections, when said door sections are closed, butting against an outer surface of at least one of said modular frame side rails; and said overlap of said siding forming an elongated door stop for the divided doors against said side rail.

5. A modular wall front for a miniature shelter in accordance with claim 1 wherein said door is a pair of divided over and under dutch-type miniature doors and wherein said miniature dowel pin hinge in said front further comprises:

three separate dowel pin sections lying along said hinge axis and said three separate dowel pin sections are seated in fitted bores in said door in order to form an upper, lower, and a middle hinge for said doors.

6. A modular wall front for a miniature shelter in accordance with claim 5, which dowel pin hinge in said front further comprises:

fitted receiving bores located at a given partial depth in each of the hinge styles on both of said miniature dutch-type door sections.

7. A modular wall front for a miniature shelter in accordance with claim 6, which miniature dowel pin hinge in said front further comprises:

means fixing said upper and lower hinge sections to the header beam and to the threshold beam by brads, glue or the like.

8. A modular wall front for a miniature shelter in accordance with claim 7, which miniature dowel pin hinge in said front further comprises:

a center hinge section seated in slightly oversized fitted receiving bores drilled in the bottom of the upper door frame and the top of the lower door frame.

9. A modular wall front for a miniature shelter in accordance with claim 1, and further comprising:

said dowel hinge pin running substantially full length of said vertically-oriented door frame style with said pin positioned at a location on the header and threshold beams which provides a swing space between an inner surface of said door frame style and the outer surface of said wall portion;

a door storage space along the front of said wall portion, which space is selected with sufficient depth for receiving said door sections when same are swung fully open; and said swing space allowing the doors to open fully into said door storage space along the wall of said modular front.

10. A modular wall front for a miniature shelter in accordance with claim 1 and further having a vertical door storage space along the front of said wall adjacent to the door opening in said wall, and said modular front further comprises:

means associated with said dowel pin hinge allowing the doors to open fully into said storage space.

11. A modular wall front for a miniature shelter in accordance with claim 10, and said modular front further comprises:

a depth for said storage space selected to receive said doors when same are swung fully open.

12. A modular wall front for a miniature shelter, which front comprises:

a header beam, a threshold beam, and side rails affixed thereto for forming an essentially rectangular modular frame adaptable as a vertically oriented closure for an opening in said miniature shelter;

a wall portion mounted on said modular frame;

a full length door opening formed in said wall portion, with said door opening located adjacent at least one of said side rails of said modular frame;

a miniature divided dutch door with upper and lower door halves hinged at the mid-point of a vertical hinge axis;

each door halve having a frame covered by siding, which frame has a vertical style at the hinge side thereof;

a dowel pin hinge slightly longer than the length of said door;

fitted bores, relative to the size of said dowel pin, placed lengthwise in said vertical style of both of said door halves in order to form, for said divided doors, a binding hinge which has a longitudinal axis centered along the center of said dowel;

exposed upper and lower stub sections of said dowel hinge extending beyond an upper and lower end of said vertical styles on said door frames;

means fixably mounting said upper exposed stub section of said dowel pin hinge in said header and said lower exposed section of said dowel pin hinge in said threshold beam such that said door is swingably mounted to open and close said door opening in said wall portion of said modular wall front;

means including said dowel pin for mounting said door halves in a vertical plane with one door halve located above the other dutch door halve such that said door halves have both swingability and lockability in position;

said dowel hinge pin running substantially full length of a vertically-oriented door support style with said pin positioned at a forward location on the header and threshold beams in order to provide a swing space between the inner door surface and the outer surface of said wall;

a door storage space along the front of said wall selected with a depth for receiving said divided dutch doors when same are swung fully open; and said swing space allowing the doors to open fully into said storage space along the wall of said modular front.

13. A modular wall front for a miniature shelter in accordance with claim 12, which front further comprises:

siding covering each of the divided dutch door sections;

said siding extending slightly beyond and overlapping the door frame on the handle side and abutting against the side rail of said modular frame when said door is in a closed condition; and said overlap of said siding forming an elongated door stop for the divided doors against said side rail.

14. A modular wall front for a miniature non-habitation shelter such as doll houses, miniature stalls and similar sized shelters useful for child's play but which has characteristics that are not suitable for habitation, which front comprises:

an essentially rectangular frame defining a vertically oriented door opening in said miniature shelter;

at least one miniature dutch-type door halve vertically oriented in said door opening to cover about either the upper or lower half of said door opening;

upper and lower door rails defining an upper and lower hinge corner on said dutch door halve;

miniature dowel pin hinge means fitted in the upper and lower corners of said dutch-type door for fixably mounting said dutch door vertically within said opening; and said miniature dowel pin hinge means for said door, although swingably mounting said door on said dowel, are characterized by binding to provide lockability in that the door stays in any given position from fully closed to fully open or in between such open and/or closed positions.

15. A modular wall front for a miniature shelter in accordance with claim 14 and further comprising:

at least a pair of over and under essentially equal sized miniature dutch-type door halves vertically oriented in said door opening to cover the upper or lower half of said door opening; and said miniature dowel pin hinge means for said door, although swingably mounting said divided dutch-type doors on said dowel hinge pin means, has binding between said divided dutch-type doors to provide both swingability and lockability in that said door stays in any given position from fully closed to fully open or in between such fully open and/or closed positions.

16. A modular wall front for a miniature shelter in accordance with claim 14 and further comprising:

said miniature dowel hinge pin means positioned at a location which provides a swing space between an inner surface of said door halve and the outer surface of said wall;

a door storage space along the front of said wall, with said space selected with a depth for receiving said divided dutch door when said door is swung fully open; and said swing space allowing the door to open fully into said storage space along the wall of said modular front.

* * * * *